United States Patent [19]

Beck

[11] Patent Number: 4,967,685

[45] Date of Patent: Nov. 6, 1990

[54] FLAG PROTECTOR

[76] Inventor: Royal L. Beck, Rte. #1, Byers, Kans. 67021

[21] Appl. No.: 405,656

[22] Filed: Sep. 11, 1989

[51] Int. Cl.[5] ..... G09F 17/00

[52] U.S. Cl. ..... 116/173; 116/174

[58] Field of Search ..... 116/173-175, 116/28 R; 40/591, 592, 602, 604

[56] References Cited

U.S. PATENT DOCUMENTS

| | | | |
|---|---|---|---|
| 982,645 | 1/1911 | Suhr | 116/174 |
| 1,360,584 | 11/1920 | Rohrbaugh | 116/173 |
| 2,527,357 | 10/1950 | Donahey | 116/174 |
| 2,909,147 | 10/1959 | Crowder | 116/173 |
| 3,286,386 | 11/1966 | Glantz | 40/592 |
| 3,636,912 | 1/1972 | Kamp | 116/28 R |
| 3,826,223 | 7/1974 | Lingo, Jr. | 116/174 |

*Primary Examiner*—William A. Cuchlinski, Jr.
*Assistant Examiner*—W. Morris Worth
*Attorney, Agent, or Firm*—Edward L. Brown, Jr.

[57] ABSTRACT

The invention is a flag protection device mounted on the upstream edge of the flag which extends laterally outward from the plane of the flag a distance of one-twelfth the flag's width so as to deflect a portion of the airstreams outwardly into the free stream air so as to cause a degree of disturbance and thereby minimize the snapping effect along the flag's downstream edge.

7 Claims, 1 Drawing Sheet

FLAG PROTECTOR

The present invention is a flag protector and more particularly a wind-deflecting device attached to the upstream edge of the flag which prevents the flag from snapping.

BACKGROUND OF THE INVENTION

Pole-mounted flags throughout history have had a limited life due to the damaging effects of wind, sun and airborne contaminants. Over the years stronger flag fibers have been adopted such as Nylon, however, the problems of unraveling the fibers along its downstream edge have persisted even though improved hemming patterns and thread have been utilized. The U.S. government generally expects a Nylon or cotton flag to last approximately 90 days based on daily usage before the trailing edge of the flag becomes too unraveled to use. The constant effects of wind will unravel the trailing edge of the flag in proportion to the wind strength to which it is exposed.

One method of increasing flag life has been to fly it during the daylight hours which under some conditions has increased flag life three fold.

Another practice which extends life, is to regularly clean the flag to remove dirt, smoke and other forms of airborne contaminants which will collect in the fabric. Life is prolonged by frequent inspection and re-hemming of the downstream edge wherein the threads break and the fabric begins to unravel. Regular re-hemming of the trailing edge certainly increases the flag's life, however, this unraveling action eventually shortens the width of the flag to the point that it is visually out of proportion and needs to be replaced. Under some conditions flags flown 24-hours a day will last less than 30 days.

In reviewing the prior art, only flag pole devices which prevent the flag from wrapping or tangling about the pole such as Suhr to U.S. Pat. No. 982,645 were located.

SUMMARY OF THE PRESENT INVENTION

The wind-deflector device of the present invention is positioned along the upstream edge of the flag, extending the full height of the flag. The device deflects outwardly a portion of the airstream passing the flag so as to minimize the passing airstream effect along the trailing edge of the flag. The deflector extends laterally outward into the airstream sufficiently far to cause a mixing effect of the deflected airstreams with the free air stream so as to reduce the downstream velocity of the wind passing the trailing edge of the flag. The deflection of these airstreams in close proximity to the plane of the flag also function to deflect to a certain degree of the airborne particulate matter including dirt which can collect in the fabric of the flag.

The distance the deflector extends outward from the plane of the flag varies with the width of the flag since the deflection or turbulent effect caused by the deflector obviously diminishes as the free stream gets farther away from the deflector. If the deflector extends laterally too far into the free stream, the vacuum effect just downstream of the deflector will cause the flag not to trail outward in its normal flying manner and it will have a tendency to hang partially downward in a partially unfurled condition. If the deflector does not extend laterally far enough, the trailing edge of the flag will whip in the same violent manner in the absence of any deflector device.

It is therefore the principal object of the present invention to provide a flag deflector mounted along the upstream edge of the flag which causes the free stream air to minimize the damaging whipping action which it normally causes.

Another object of the present invention is to provide a relatively simple inexpensive wind deflector device for use with pole-mounted flags which substantially increases flag life and is essentially not visible.

Other objects and advantages of the present invention will become apparent to those skilled in the art from the following description read in conjunction with the accompanying drawings in which.

DESCRIPTION OF THE PREFERRED EMBODIMENT

Figure 4:
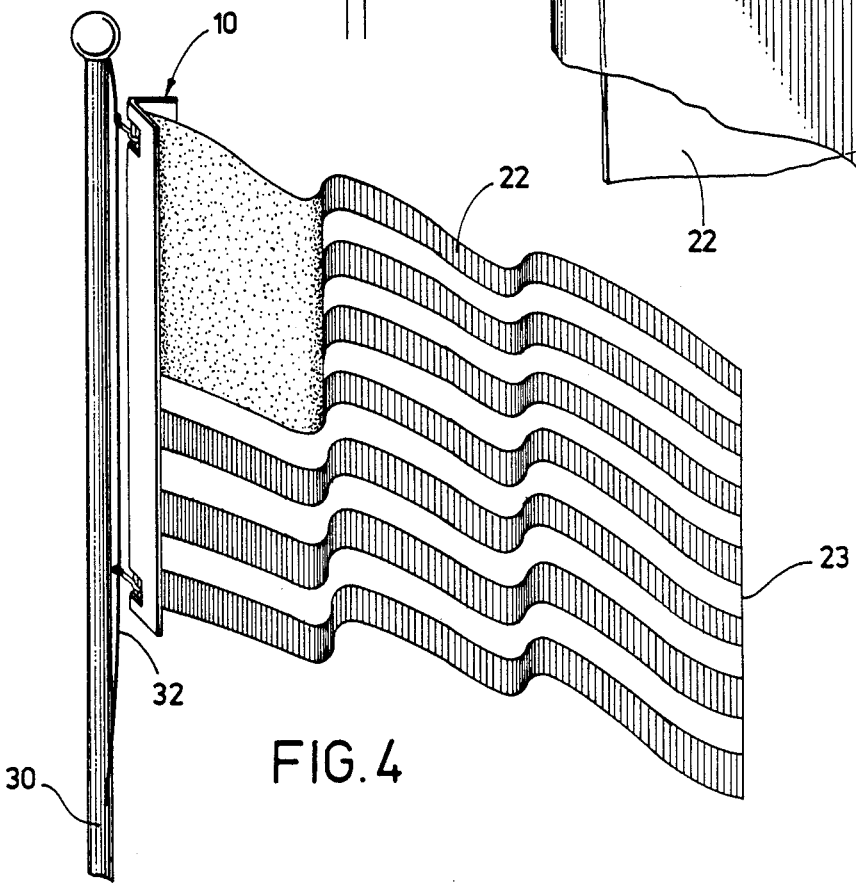
FIG. 4 is an overall elevational view of a pole-mounted flag with the deflector device.

The flag wind deflector of the present invention is generally described by reference numeral 10 and is illustrated in FIG. 4, positioned on a conventional flag pole 30 at the upstream edge of a conventional flag 22. Conventional flags of varying sizes are pole-mounted on a rope 32 through snap hooks 26 to a pair of grommets 24 located at the top and bottom edges of a flag.

Figure 1:
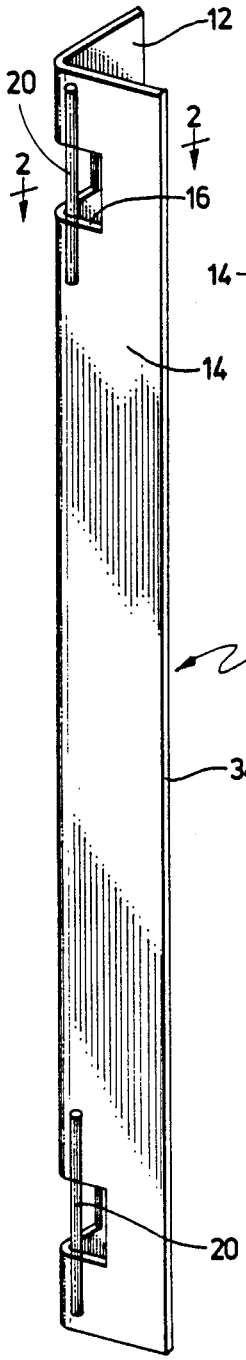
FIG. 1 is a side perspective elevational view of the wind-deflector device of the present invention.
Figure 2:
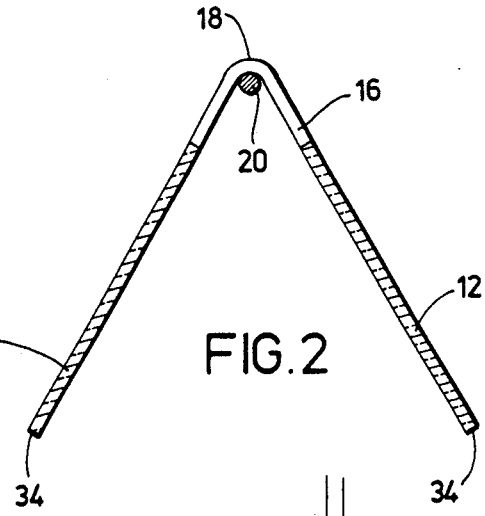
FIG. 2 is a lateral section taken along lines 2—2 of FIG. 1.
Figure 3:
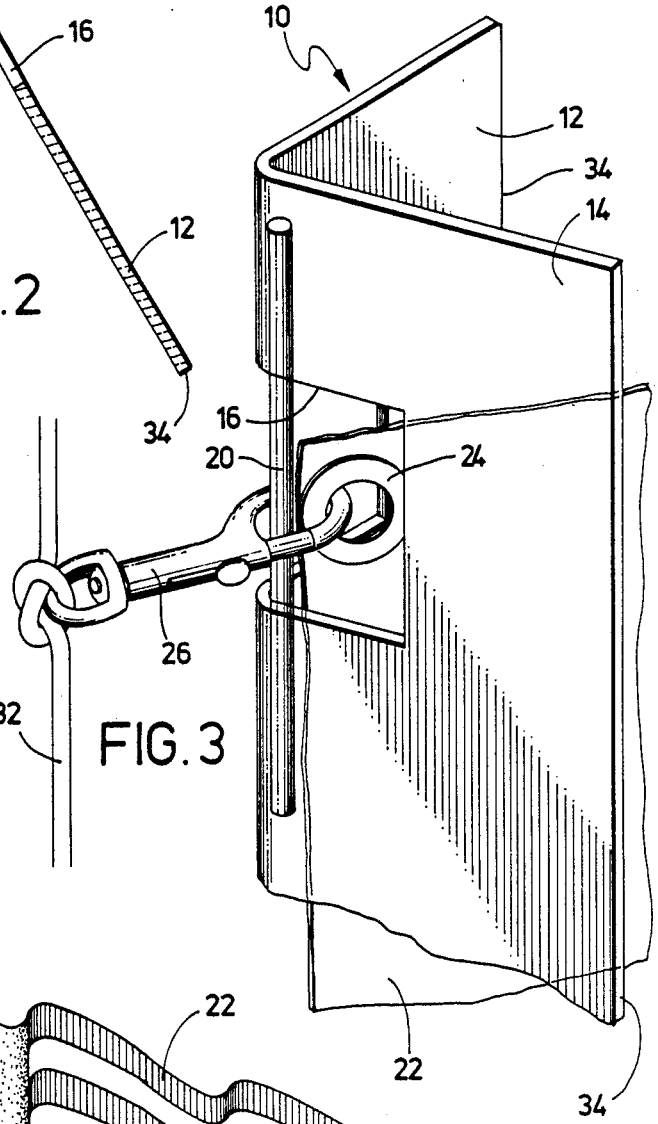
FIG. 3 is a partial elevational view to an enlarged scale of the wind deflector attached to a snap hook and a pole-mounted flag.

The deflector device 10 of the present invention is formed from a sheet of plastic cast acrylic having two planar sections 14 and 12 which are joined along a longitudinal edge 18, as best seen in FIG. 2. The preferred form of fabrication involves bending a single plastic sheet along longitudinal edge 18 to form the two planar sections 12 and 14. Located approximate the ends of the deflector 10 are a pair of openings 16 which pass through portions of both panels 12 and 14 and are longitudinally located opposite the flag grommets 24, as best seen in FIG. 3. Spanning each of the openings 16 and attached to the longitudinal edge 18 of the deflector are a pair of metal rods 20 which can be glued to the deflector 10 or attached by any other means. The rods 20 provide a mounting means for attaching the deflector 10 to the flag through engagement of snap hooks 26 which also engage rods 20.

The deflector 12 comprises two planar sections 12 and 14 which join along longitudinal edge 18. Sections 12 and 14 are positioned at an angle of preferably 90° with each other. The longitudinal length of deflector 10 is substantially the height of flag 25. The sections 12 and 14 have a lateral width which is proportioned to the flag width at a ratio of approximately 1 to 15. If the ratio is less than 1 to 12, the effect of the deflector is too strong and the flag will not fully extend in a wind condition.

OPERATION

With the deflector 10 positioned on the leading edge of the flag 22, as best seen in FIG. 4, the flag will trail outward in a fully extended position in a slight waving action, as symbolically illustrated. The waving action with deflector 10 is substantially different from the normal violent whipping action that takes place without deflector 10. This violent snapping action along the trailing edge 23 breaks and unravels the threads of the flag thus causing the flag to lose its hem and begin to unravel. With the use of the wind deflector of the present invention, this whipping action at the trailing edge is substantially reduced in strength and amplitude and thereby places less strain on the flag while still allowing it to trail outward in a fully extended position.

When the deflector 10 is in use, it is essentially not visible since it is fabricated from a clear cast acrylic plastic material such as Plexiglas. The particular lateral width of the deflector 10 on a conventional 3'×5' flag, is approximately 4 inches. Larger sized flags, of course, require a greater lateral width of the deflector so that the ratio of lateral width to flag width is approximately 1 to 15.

Having described the invention with sufficient clarity to enable those familiar with the art to construct and use it, I claim:

1. A flag wind deflector for use on a pole having a pair of flag-engaging hooks, the deflector comprising:

two planar sections joined along a common longitudinal edge, the sections having a length at least the height of the flag being protected, each section having a width extending laterally outwardly a distance of at least 1/12 (one-twelfth) the flag's width; and deflector support means including a pair of hook-engaging rod members positioned and attached along said common longitudinal edge, a pair of openings in the planar sections adjacent a portion of each rod member and the openings being spaced apart a distance for releasable receipt of the flag-engaging hooks.

2. A flag wind deflector as set forth in claim 1 wherein the planar sections are transparent and form an acute angle at their juncture with each other.

3. A flag wind deflector as set forth in claim 1, wherein the planar sections form an angle of substantially 90°.

4. A flag wind deflector as set forth in claim 1 wherein the planar sections form an angle of substantially 90° and the deflector is constructed of a single piece of transparent plastic bent along said longitudinal edge.

5. A flag wind deflector as set forth in claim 1, wherein the width of each planar section is approximately 1/15 (one-fifteenth) the flag's width.

6. A flag wind deflector as set forth in claim 1, wherein the width of each planar section is in a range between 1/12 (one-twelfth) to 1/20 (one-twentieth) the flag's width.

7. A flag wind deflector as set forth in claim 1, wherein the deflector is constructed of a single sheet of plastic with a thickness in a range between 3/32 inch (three-thirty seconds inch) and ¼ inch (one-quarter inch).

* * * * *